United States Patent [19]

Hart

[11] 4,151,362

[45] Apr. 24, 1979

[54] ELECTRIC FURNACE ROOF

[75] Inventor: Ronald L. Hart, Mt. Lebanon, Pa.

[73] Assignee: Dresser Industries, Inc., Dallas, Tex.

[21] Appl. No.: 857,058

[22] Filed: Dec. 5, 1977

[51] Int. Cl.[2] ..... F27D 1/02

[52] U.S. Cl. ..... 13/35; 110/335

[58] Field of Search ..... 13/35; 110/331, 335

[56] References Cited

U.S. PATENT DOCUMENTS

| | | | |
|---|---|---|---|
| 3,005,424 | 10/1961 | Heuer | 110/335 |
| 3,367,292 | 2/1968 | Woodruff et al. | 13/35 X |
| 3,385,241 | 5/1968 | Alvis et al. | 13/35 X |

*Primary Examiner*—R. N. Envall, Jr.

*Attorney, Agent, or Firm*—Raymond T. Majesko; John N. Hazelwood

[57] ABSTRACT

Electric furnace roof comprising key-arch-wedge refractory shapes contained in adjacent concentric rings within a roof band, expansion allowance means disposed between brick in both the radial and circumferential direction and spacer means disposed between brick in at least the radial direction.

5 Claims, 3 Drawing Figures

ELECTRIC FURNACE ROOF

Electric arc furnace equipment for the melting of steel is lined with refractory shapes to withstand high operating temperatures. One part of the refractory lined equipment is the roof, which is subject to a multiplicity of potentially destructive conditions. These are high temperatures, electric arc flare, oxygen-rich atmosphere, iron oxide attack, physical abuse, abrasion from particulate airborne matter, stresses from operational movement and frequent thermal variations. All these tend to disrupt the structural balance and the material integrity of the brick dome or refractory portion of the roof.

Present dome construction materials and designs are not capable of withstanding high production requirements which severely impose one or more of the destructive conditions without incurring costly production delays and uneconomical operating cost. These costly situations are mainly the result of accelerated wearing away of the working face of the brick and/or loss of structural stability of the dome causing premature campaign termination. Materials whose contour or structural stability can be most easily controlled, are most subject to accelerated wear. Materials which wear well present structural stability problems due to their chemical compositions, leading to high thermal expansion at operating temperatures. Previous attempts to harness compatible materials and design to operating conditions have been either totally unsuccessful or only partially accepted.

Accordingly, it is among the objects of this invention to provide an electric furnace roof with a self-supporting dome utilizing a system of materials and design with calculated and uniform expansion allowance materials, and provisions which will allow maximum economic service from the dome structure without the use of external metal plating on the refractory shapes utilized therein.

Figure 1:
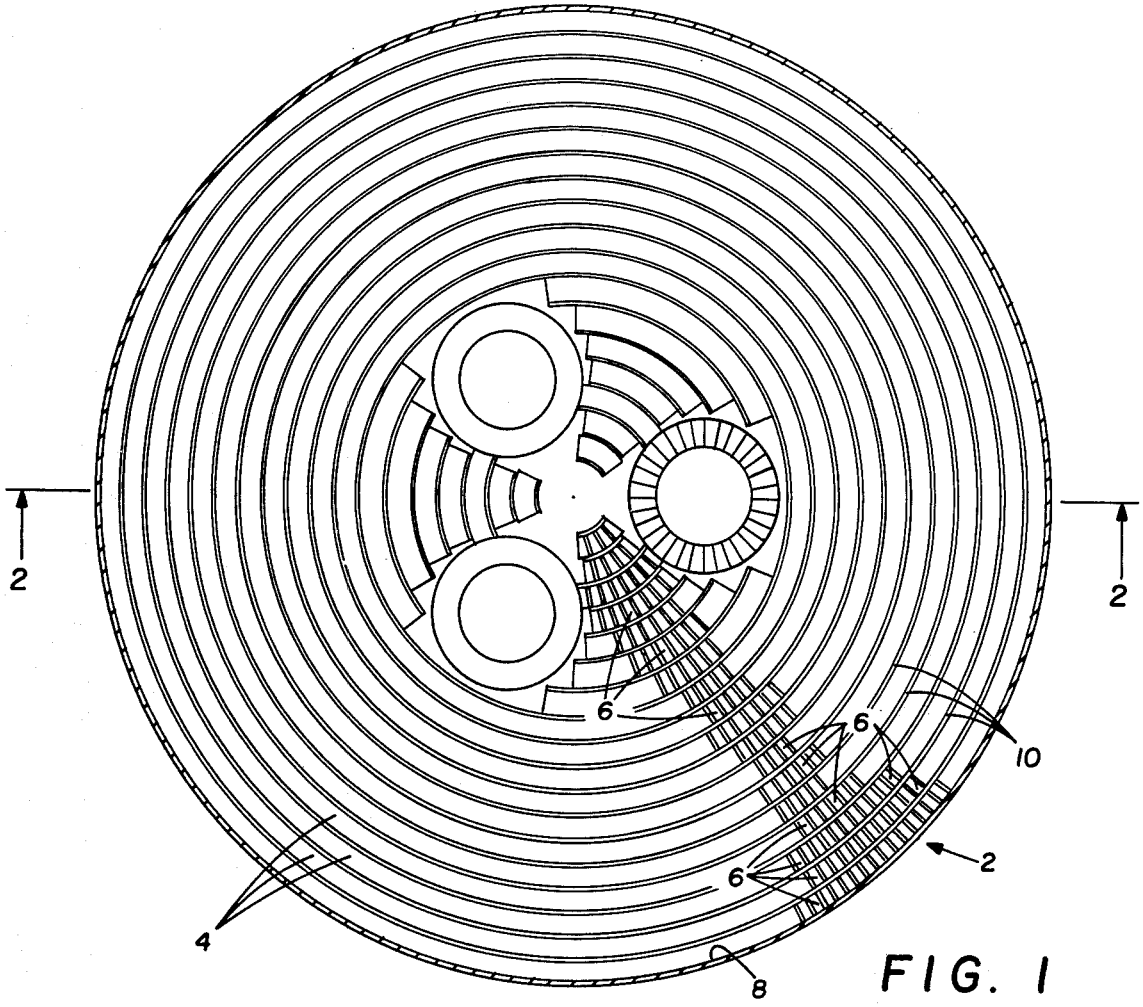
FIG. 1 is a top plan view of an electric furnace roof made in accordance with the present invention.
Figure 2:
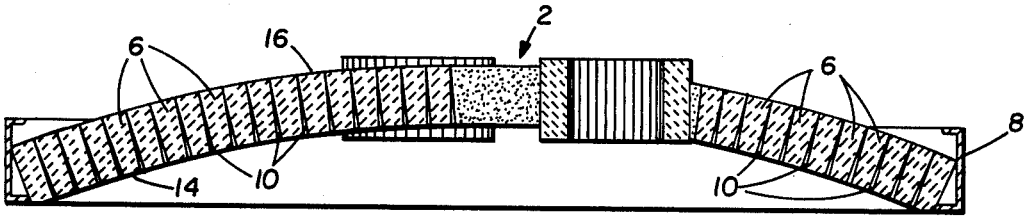
FIG. 2 is an elevation view taken along line A—A of FIG. 1.
Figure 3:
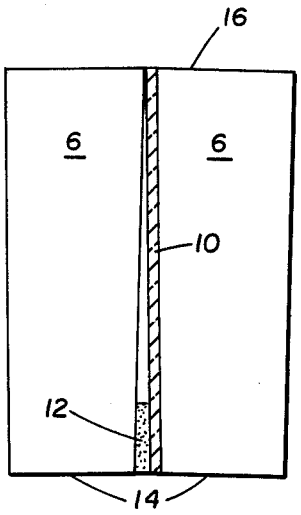
FIG. 3 is an elevation view of a pair of brick taken from FIG. 2 to show more clearly the expansion allowance means and spacer means relationship.

In accordance with the present invention, there is provided a sprung electric furnace roof having a downwardly-opening dish-shaped, dome-type roof. The roof is fabricated from a plurality of key-arch-wedge refractory shapes contained in adjacent concentric rings within a roof band. The shapes have a hot face and a cold face. Expansion allowance means are disposed substantially the entire distance, between brick in both the radial and circumferential direction. Spacer means are disposed, a relatively short distance above the hot face, between brick in at least the radial direction. The roof is completely devoid of any metal plating or suspension.

Preferably, the spacer means is also disposed between brick in the circumferential direction. Also, the refractory shapes need only be of two different sizes throughout the roof. It is further preferred that the refractory shapes in the roof are composed of basic refractory material and the spacer means are composed of mineral or ceramic fiber.

The peripheral element or roof ring supports outer annular brick rings and an inner center refractory section to form a dome. This dome is self-supporting and constructed of brick of calculated tapers. These tapers make allowance for the bricks which expand due to the operating temperatures. The brick wear due to the destructive operational mechanisms and rise due to the temperature and gradient through the dome. These situations occur without developing premature destructive stresses to the individual brick or groups of bricks in a localized portion or to the total dome structure. A roof so constructed yields economics and campaign length so as to give better overall performance than conventional or special similar structures commonly used for this type of service. This roof structure is constructed with the insertion of supplemental expansion allowance materials of calculated dimensions and properties. These are uniformly placed to cushion those additional or localized stresses for which brick shapes normally cannot allow.

In this type of furnace, the roof is normally horizontal in its position of use, but it is tilted with the furnace when the furnace is tapped of its molten charge material and is raised and swung for receipt of the charge material. Being a dome of conventional, normal weight, there is no need to modify present roof machinery for lifting, tilting or swinging. Special design bricks are utilized to give favorable physical relationships of individual brick to each other, giving more uniform force distribution throughout the structure.

Materials selected are compatible with operating conditions. This is contrasted with techniques which utilized suspension devices in an attempt to restrictively control internal stresses within the dome or the use of non-uniform application for stress relief. Construction procedures require a minimum of crafts. Man-hours required is comparable to conventional roofs.

Referring to the drawings, there is shown a downwardly-opening, dish-shaped, dome-type electric furnace roof 2. The roof is fabricated of a number of concentric rings 4 of key-arch-wedge refractory shapes 6. The outer concentric ring is supported by a roof band 8. The roof 2 is entirely self-supporting without the use of any suspension mechanism. None of the refractory shapes 6 contain metal plating or casing.

An expansion allowance means 10 in the form of mineral fiber or ceramic fiber sheets are glued the entire length of the brick to provide expansion allowance between brick in both the radial and circumferential direction. A short spacer means 12, which may also be composed of similar material, is disposed between the expansion allowance and adjacent brick in the radial direction (and circumferential if desired). Lengthwise, the spacer is disposed from the hot face to a short distance above the hot face.

As the brick length decreases due to wear and the hot face 14 and cold face 16 wedge dimension increase due to thermal expansion resulting from operating temperatures, the hot face joint with spacer and hot face thickness with compressible expansion allowance, must accommodate the high hot face temperatures by the closing of the hot face joint with spacer and compression of the hot face thickness with compressible expansion allowance, while the compression of the cold face thickness with compressible expansion allowance accommodates the cold face temperature, thus retaining the unit contour.

Any condition where expansion, wear and temperature have closed the hot face joint and destroyed the compressible expansion allowance material near the hot face, a cold face joint is caused. Rapid and significant structural rise will occur at this location or other locations resulting in loss of contour and structural stability plus termination of the roof campaign.

In addition to these relationships, the shape dimensions for the key-arch-wedge brick shapes are calculated to comprehend the relatively high, e.g. 2600° F. hot face or working face 14 temperature and the relatively low, e.g. 700° F. cold face 16 temperature experienced during the roof campaign. While the hot face temperature is relatively constant at the same time of the heat (or batch) cycle, the cold face temperature increases as wear on the hot face reduces the thickness of the brick in the dome. The shape relationship is maintained by the spacer 12 and to compensate for the varying relationships of brick thickness.

The essence of the invention is that the calculations are progressive, considering the continuing consumption of the hot face portion of the structure in service up to the point of probable campaign termination. Calculating the average condition at which the support of the roof will, due to expansion, wear and rise, change from the stable, unaltered, structural integrity of the cold face of the brick to the altered, brittle hot face of the brick, is possible. From this determination back-calculating to the necessary initial dimensions which will achieve desirable retention of contour is possible.

It is intended that the foregoing description and drawings be construed as illustrative and not in limitation of the invention.

Having thus described the invention in detail and with sufficient particularity as to enable those skilled in the art to practice it, what is desired to have protected by Letters Patent is set forth in the following claims.

The embodiments of the invention in which an exclusive property or privilege is claimed are defined as follows:

1. In a sprung electric furnace roof having downwardly-opening dish-shaped dome-type roof, said roof being fabricated of a plurality of key-arch-wedge refractory shapes contained in adjacent concentric rings within a roof band, said shapes having a hot face and a cold face, expansion allowance means disposed, substantially the entire distance, between brick in both the radial and circumferential direction, spacer means, disposed from the hot face to a relatively short distance above the hot face, between brick at least in the radial direction, said roof being devoid of any metal plating or suspension.

2. Roof of claim 1, in which the spacer means is also disposed between brick in the circumferential direction.

3. Roof of claim 1, in which the refractory shapes are of only two different sizes.

4. Roof of claim 1, in which the refractory shapes are composed of basic refractory material.

5. Roof of claim 1, in which the expansion and spacer means is composed of mineral or ceramic fiber.

* * * * *